United States Patent [19]

Gasser

[11] 4,222,478

[45] Sep. 16, 1980

[54] ARTICLE FEEDING SYSTEM FOR PARALLEL-OPERATING MACHINES

[75] Inventor: Markus Gasser, Gächlingen, Switzerland

[73] Assignee: SIG-Schweizerische Industrie-Gesellschaft, Neuhausen am Rheinfall, Switzerland

[21] Appl. No.: 11,895

[22] Filed: Feb. 13, 1979

[30] Foreign Application Priority Data

Feb. 14, 1978 [CH] Switzerland ..... 1637781

[51] Int. Cl.[3] ..... B65G 47/51

[52] U.S. Cl. ..... 198/358; 198/360; 198/367; 198/444

[58] Field of Search ..... 198/356, 357, 358, 360, 198/367, 369, 372, 444; 53/493

[56] References Cited

U.S. PATENT DOCUMENTS 3,648,820 3/1972 Schafer et al. ..... 198/358

4,164,277 8/1979 Fluck et al. ..... 198/369

FOREIGN PATENT DOCUMENTS 640666 12/1963 Belgium ..... 198/356

568908 11/1975 Switzerland .

*Primary Examiner*—Jeffrey V. Nase

*Attorney, Agent, or Firm*—Spencer & Kaye

[57] ABSTRACT

A system for feeding spaced, serially arranged articles to a plurality of article processing machines operatively connected to the system and including a plurality of normally, simultaneously operating article processing machines and a standby article processing machine for assuming the operation of a non-operating normal machine. Upstream of each normal article processing machine there is arranged an article aligning (row aligning) apparatus each provided with a deflector which directs, via conveyors, the articles either to the associated, normally operating machine or to the standby machine.

14 Claims, 4 Drawing Figures

ARTICLE FEEDING SYSTEM FOR PARALLEL-OPERATING MACHINES

BACKGROUND OF THE INVENTION

This invention relates to a system for advancing articles to a plurality of normally simultaneously and parallel-operating machines for processing articles introduced into the machines serially and in a spaced relationship. The system also serves a standby machine that takes over the function of a normal machine should the latter break down. Such systems find application particularly for packaging purposes and thus cooperate with packing machines.

Known systems of the above-outlined type require substantial space and further, articles may become separated from the series and leave the feed tracks at locations which are, in most cases, accessible only with difficulty. Thus, even in case of automatic operating systems, a continuous monitoring is necessary which requires substantial labor.

SUMMARY OF THE INVENTION

It is an object of the invention to provide an improved system of the above-outlined type from which the discussed disadvantages are eliminated.

This object and others to become apparent as the specification progresses, are accomplished by the invention, according to which, briefly stated, upstream of each article processing machine there is arranged a row aligning apparatus each having a deflector which directs, via conveyors, the articles either to the associated, normally operating machine or to the standby machine.

According to a particular feature of the invention, the system is so structured that a frequent on-and-off switching of the standby machine is avoided; in this manner the operational safety is increased and losses are reduced.

DESCRIPTION OF THE PREFERRED EMBODIMENT

Figure 1:
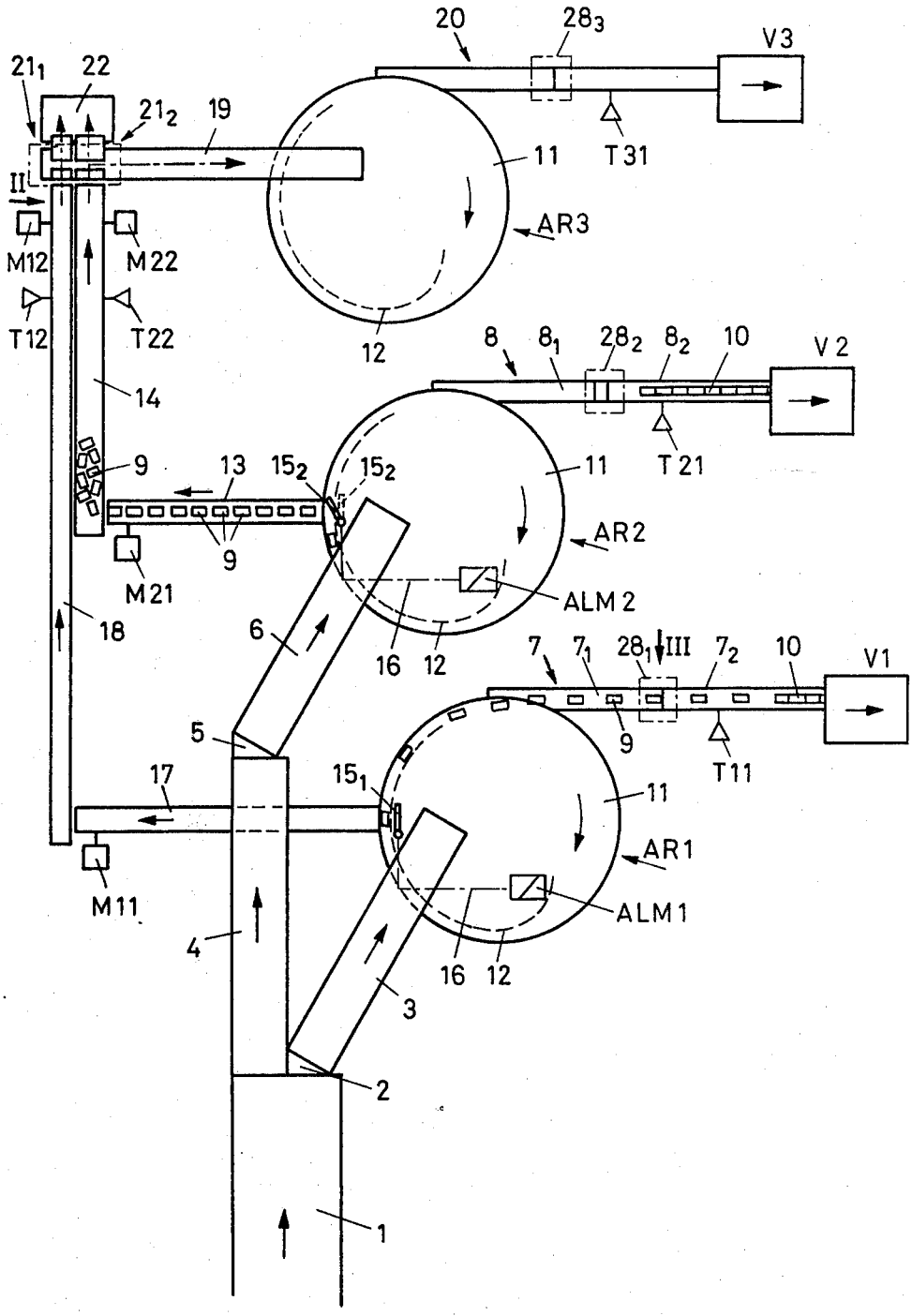
FIG. 1 is a schematic top plan view of a preferred embodiment of the system according to the invention.

The illustrated article feeding system serves in this example packing machines for chocolate bars or the like. Two packing machines V1 and V2 operate normally and in a simultaneous, parallel manner, while the packing machine V3 is a standby machine for the event that one of the normally operating packing machines V1 or V2 breaks down.

The elongated articles to be wrapped by the packing machines are introduced into the article feeding system by means of a wide input belt 1 from which they are advanced in part to a first aligning apparatus AR1 by means of a chute 2 and a narrower conveyor belt 3 and in part to a second aligning apparatus AR2 by means of a conveyor belt 4, a chute 5 and a conveyor belt 6. The aligning apparatuses AR1 and AR2 are row-organizers which, during normal operation, simultaneously provide the two machines V1 and V2 with individual, mutually spaced articles 9 by means of conveyor belts 7 and 8. At the machine inlet, that is, in the discharge zone of the belts 7 and 8, the articles 9 are at a somewhat crowded (accumulated) condition as indicated at 10. The aligning apparatuses AR1 and AR2 are of conventional structure and are disclosed, for example, in Swiss Pat. No. 568,908. In these apparatuses the randomly arranged articles drop on a turntable 11 and are aligned by means of a guide rail 12 indicated in FIG. 1 in phantom lines and attached fixedly to the machine frame. The guide rail has angular bends which are not shown in the Figures.

With the conveyor belts 7 and 8 there are associated sensors T11 and T12 which are arranged at a certain distance from the respective packing machines V1 and V2 and which serve to determine whether the accumulation 10 exceeds a predetermined limit. Such an occurrence would mean that the rate of article supply to the respective machine is greater than its packing rate. Such a situation is illustrated for the conveyor belt 8. For eliminating such an accumulation in a manner to be described later, an article-withdrawing belt 13 is provided which extends from the aligning apparatus AR2 and which leads from the turntable 11 to a belt 14 designated as a "buffer belt". The articles 9 are deposited on the belt 13 when a deflector arm $15_2$ pivotally mounted on the machine frame at the aligning apparatus AR2 is in its deflecting position illustrated in solid lines in FIG. 1. The deflecting arm $15_2$ is controlled by means of an electromagnet ALM2 which is fixedly mounted on the machine frame and which is connected to the arm $15_2$ by means of a linkage 16. It is noted that the non-deflecting position of the arm $15_2$ is indicated in broken lines. In a similar manner, at the aligning apparatus AR1 there is arranged an article-withdrawing belt 17 which leads to a buffer belt 18. Since the deflecting arm $15_1$ actuated by an elecrtromagnet ALM1 and associated with the aligning apparatus AR1 is in its non-deflecting position, the belt 17 is not charged with articles and thus the articles 9 which are situated on the turntable 11 associated with the packing machine V1 are transferred onto the belt 7 and are thus fed to the packing machine V1. For driving the article-withdrawing belts 13 and 17 there are provided respective motors M21 and M11 which are energized when the associated deflecting arm $15_2$ of $15_1$ directs articles 9 onto the respective belt 13 or 17. Similarly, for driving the buffer belts 14 and 18 there are provided respective motors M22 and M12 which are energized simultaneously with the energization of the motors M21 and M11. It is feasible to provide in each instance a single motor for driving the belts 13 and 14 or, respectively, 17 and 18. Instead of energizable and de-energizable motors, it is further feasible to provide continuously running motors which are equipped with switchable electric clutches.

The buffer belts 14 and 18 which extend parallel to one another, lead to a collecting belt 19 which has a discharge end that is situated above a turntable 11 of a third aligning apparatus AR3 which feeds the standby machine V3 by means of a belt 20. With each buffer belt 14 and 18 there is associated a respective bypass chute $21_2$ and $21_1$ which, by bypassing (bridging) the belt 19 provides that the articles delivered by the buffer belts 14 and 18 are not admitted to the belt 19 but are deposited in a collecting bin 22.

Figure 2:
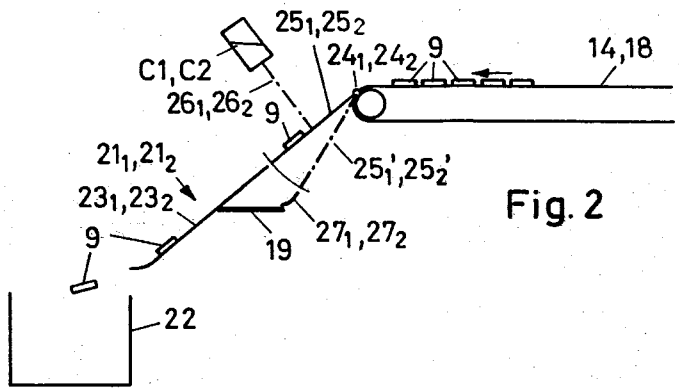
FIG. 2 is an enlarged schematic side elevational view of a detail of the structure shown in FIG. 1, as seen in the direction of the arrow II of FIG. 1.

The operation of the bypass chute $21_1$ serving the buffer belt 18 will now be described in conjunction with FIG. 2. The chute $21_1$ has a lower chute portion $23_1$ which is affixed to the machine frame and which has a discharge end above the collecting bin 22. An upper chute portion $25_1$ is mounted for pivotal motion about an axis $24_1$ and is movable thereabout by means of an electromagnet Cl with the intermediary of a linkage $26_1$. The pivotal axis $24_1$ is located at the discharge end of the buffer belt 18. Upon energization of the electromagnet Cl, the pivotal chute portion $25_1$ is brought into alignment with the lower chute portion $23_1$ so that these two chute portions then together bridge (bypass) the belt 19 and cause all articles 9 delivered by the belt 18 to slide into the collecting bin 22. It is noted that in the FIG. 1 illustration of the system, there are no articles on the belt 18. When the electromagnet Cl is in a de-energized condition, the pivotal chute portion $25_1$ is in its phantom-line position $25_1'$ in which it is in alignment with a short, fixedly supported end portion $27_1$ which is situated directly adjacent the belt 19. In the position $25_1'$ of the upper chute portion $25_1$ the articles 9 conveyed by the belt 18 are transferred to the belt 19. The bypass chute $21_2$ associated with the buffer belt 14 is controlled by an electromagnet C2 via linkage $26_2$ and has components $23_2$, $24_2$, $25_2$ and $27_2$ which correspond in structure, arrangement and function to the components 23, 24, 25, and 27, of the bypass chute $21_1$. The bypass chute $21_2$ differs from the bypass chute $21_1$ associated with the belt 18 only in that it is somewhat wider and its width dimension corresponds to that of the belt 14. The belt 14 is shorter, yet wider than the belt 18 and thus has approximately the same buffer capacity (article storing capacity) as the longer belt 18. Stated differently, the two buffer belts 14 and 18 are able to accommodate an equal number of articles 9. The speed of the belt 14 is accordingly less than that of the belt 18. In FIG. 1 only a few articles 9 are shown on the belt 14; they are at a random orientation as they are deposited thereon by the belt 13. It is noted that for the sake of simplicity the articles are shown in an aligned manner behind one another on the belt 13. The belts 13 and 17 which also function as buffers, could be of unlike width similar to the belts 14 and 18. The two bypass chutes $21_1$ and $21_2$ are—as will be discussed in more detail later—interlocked with one another in such a manner that the belts 14 and 18 cannot simultaneously supply the belt 19 (and thus the aligning apparatus AR3 and the standby machine V3) with articles. In the discharge zone of the buffer belts 18 and 14 there are provided respective sensors T12 and T22 which determine whether there are articles on the buffer belts which they serve. A further sensor T31 is associated with the belt 20. The purpose of the sensor T31 corresponds to that of the sensors T11 and T21 of the belts 7 and 8. The system further has non-illustrated drive motors which continuously drive the belts 1, 3, 4, 6, 7 and 8 as well as the turntables 11 of the aligning apparatuses AR1 and AR2 and which drive the belts 19 and 20 as well as the turntable 11 of the aligning apparatus AR3 only when required. It is noted that the sensors T11, T12, T21, T22 and T31 may be of any known appropriate structure; they may be optical and/or mechanical sensors.

The non-illustrated drive motors of the packing machines V1, V2 and V3 are automatically energized when articles 9 reach their inlet and are automatically de-energized when no more articles pass therethrough. It is feasible, however, to manually start and stop there machines by means of an appropriately designed circuit.

Figure 3:
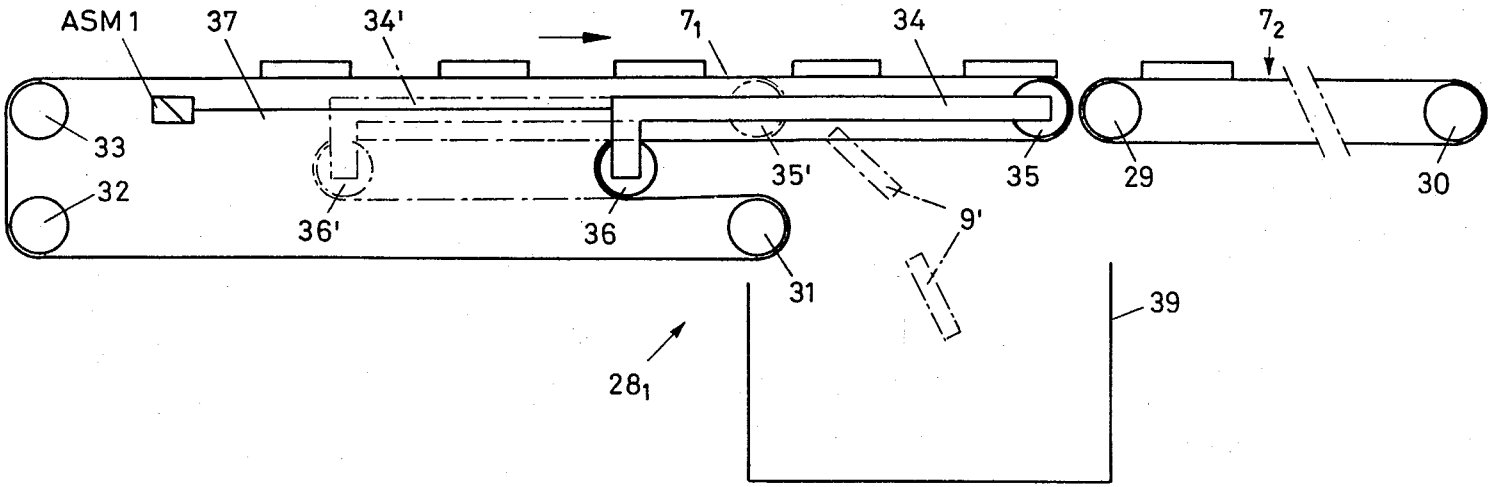
FIG. 3 is an enlarged schematic side elevational view of a detail of the structure shown in FIG. 1, as viewed in the direction of the arrow III of FIG. 1.

In the path of the belts 7, 8 and 20 there are arranged respective articles eliminators $28_1$, $28_2$ and $28_3$. The mode of operation of the article eliminator $28_1$ will now be discussed in conjunction with FIG. 3. The belt 7 is formed of two endless belt portions $7_1$ and $7_2$. The belt portion $7_2$ is trained about two rollers 29 and 30 supported in the machine frame whereas the belt portion $7_1$ is trained about three rollers 31, 32 and 33 supported stationarily in the machine frame. The belt portion 7 is further trained about two spaced rollers 35 and 36 mounted on a shiftable slide 34. The latter is movable in the one or the other direction by means of an electromagnet ASM1 with the intermediary of a linkage 37 with the possible interposition of a non-illustrated servomechanism. In the full-line position of the slide 34 the belt portions $7_1$ and $7_2$ complement each other into a continuous conveyor belt 7. In the phantom-line position 34' of the slide 34, on the other hand, between the rollers 29 and 35 (assuming the position 35') there is a wide gap through which the articles 9' may fall into a collecting bin 39. The length of the belt portion $7_1$ remains unchanged upon the shift of the rollers 35 and 36 into the position 35' and 36'. The article eliminators $28_2$ and $28_3$ serving the belts 8 and 20 are structured similarly to the above-described article eliminator $28_1$.

Figure 4:
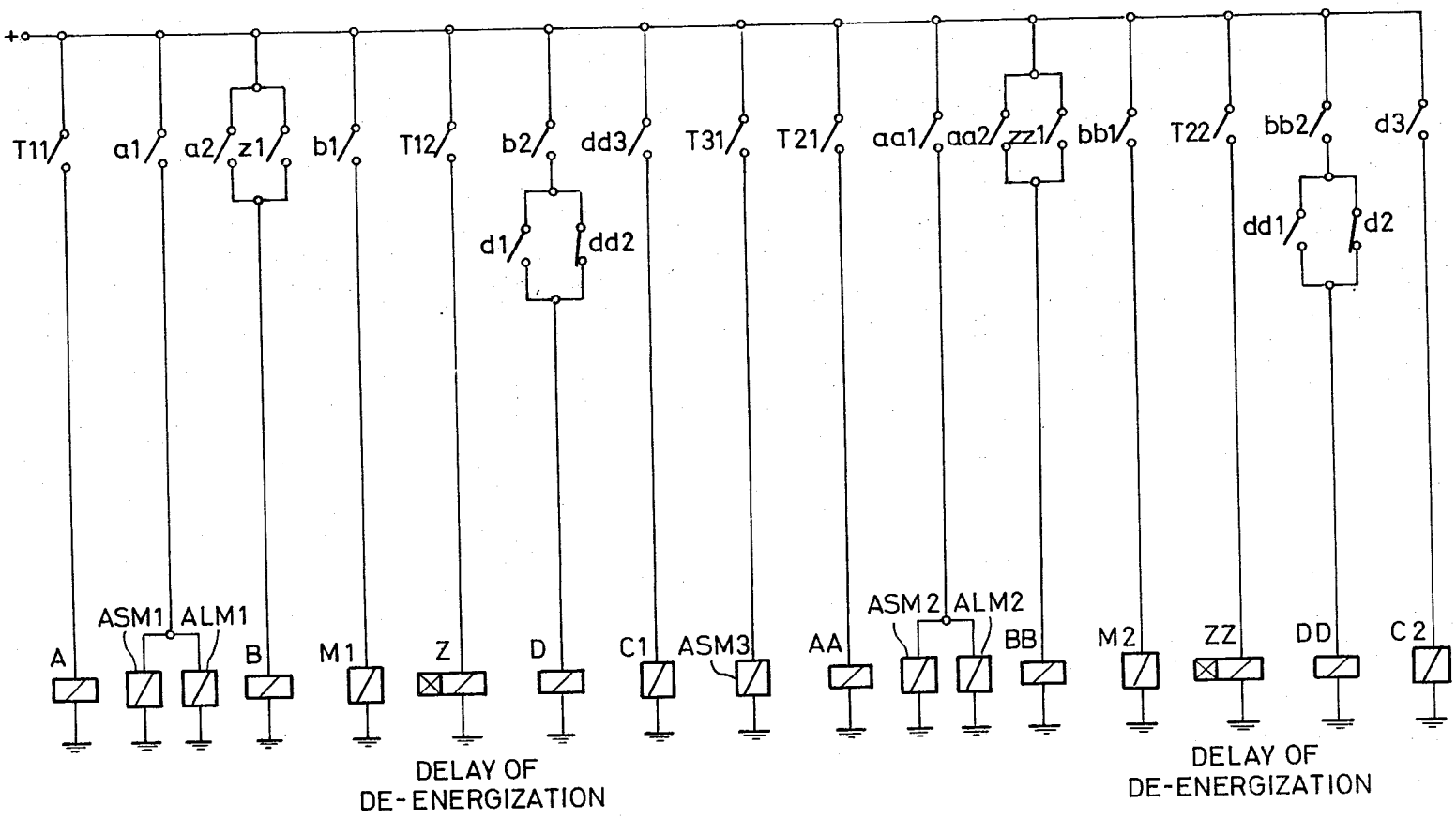
FIG. 4 is an electric circuit diagram for operating the system illustrated in FIG. 1.

Turning now to FIG. 4, there is illustrated the electric control of the above-described system. The control comprises two groups of elements which are shown in FIG. 4 in a juxtapositioned relationship. The left-hand group is associated with the packing machine V1 and the buffer belt 18, whereas the right-hand group serves the packing machine V2 and the buffer belt 14. Between the two groups there are further illustrated the sensor T31 and a solenoid ASM3 which are associated with the standby machine V3.

The left-hand group comprises four delays A, B, Z and D; a solenoid switch M1 whose energization causes actuation of the motors M11 and M12; solenoids ASM1, ALM1 and Cl which control, respectively, the article eliminator $28_1$ of the machine V1, the deflector arm $15_1$ of the aligning apparatus AR1 and the pivotal chute portion $25_1$ of the bypass chute $21_1$ of the belt 18; and the two sensors T11 and T12 which are associated with the belts 7 and 8.

The right-hand group comprises the relays AA, BB, ZZ and DD which, respectively, correspond to the relays A, B, Z and D; a solenoid switch M2 for the motors M21 and M22 for the respective belts 13 and 14; solenoids ASM2, ALM2 and C2; as well as the two sensors T21 and T22.

All the relay contacts in FIG. 4 are shown in a position which they assume during normal operation wherein all relays are in a de-energized state and all sensors are open (that is, in a non-responding state) and further, on the respective belts there are no articles or at least no articles in an accumulated state. It is noted that the lower-case letters appearing next to the contacts in FIG. 4 indicate the respective relay to which they belong.

Assuming now that the packing machine V2 works too slowly with respect to the charging rate of the belt 8, the accumulation 10 at the machine inlet increases to such an extent that the sensor T21 closes and thus energizes the relay AA. By virtue of the closing of the normally open contact aa1 of the relay AA, the deflector solenoid ALM2 and the article eliminating solenoid ASM2 are energized, so that the deflecting arm $15_2$ of the article aligning apparatus AR2 is moved from its broken-line position into its solid-line, deflecting position (FIG. 1) and the slide 34 of the article eliminator $28_2$ of the belt 8 is moved into the eliminating position 34'. The articles 9 fed to the turntable 11 of the aligning apparatus AR2 are now deflected to the article-withdrawing belt 13. Those articles which are already on the turntable 11 behind the deflecting arm $15_2$ as well as the articles which are already on the belt portion $8_1$ fall into the collecting bin 39 of the respective article eliminator $28_2$.

The closing of the normally open contact aa2 of the relay AA effects energization of the relay BB, whose normally open contact bb1 closes the circuit of the solenoid switch M2. The latter thus energizes the motors M21 and M22 of the belts 13 and 14 which thus convey the articles 9 deflected from the article aligning apparatus AR2 to the collecting belt 19. Such an occurrence will take place, because the pivotal chute portion $25_2$ of the belt 14 is in alignment with the end portion $27_2$, since the solenoid C2 is not energized. By closing the normally open contact bb2 of the relay BB, the relay DD is energized via the normally closed contact d2 of the relay D. As a result, the relay DD closes its normally open contact dd1—through which the relay Dd remains energized even if the normally closed contact d2 is opened—and simultaneously opens its normally closed contact dd2 which is in the circuit of the relay D. Further, upon closing the normally open contact dd3 of the relay DD, the solenoid C1 is energized so that the chute portion $25_1$ of the belt 18 is aligned with the chute portion $23_1$ thus setting the chute $21_1$ into its bypassing state.

If, however, the accumulation 10 on the belt 8 is being reduced by the packing machine V2 before the articles 9 on the buffer belt 14 have reached the sensor T22, then by virtue of the opening of the sensor T21 (which occurs due to accumulation 10 falling below a limit value), the relay AA is de-energized and the original state of the circuit is re-established. The belt 14 is merely advanced somewhat, the collecting belt 19 has not yet received any articles and the standby machine V3 has not yet started its operation. If, however, due to further accumulations in front of the machine V2—for example, because of a breakdown of the machine V2—articles 9 reach the sensor T22 as a result of a longer closed (responding) state of the sensor T21, the motors M21 and M22 are not de-energized until all the articles on the belts 13 and 14 are advanced by the collecting belt 19 and the aligning apparatus AR3 to the standby machine V3. For this purpose the sensor T22 closes every time an article 9 passes by.

The sensor T22 is thus closed by means of the leading article 9 on the buffer belt 14 and, as a result, the relay ZZ is energized which, through its now-closed, normally open contact zz1 maintains the relay BB in an energized state even if the normally open contact aa2 is opened (because of opening of the sensor T21 and the resulting de-energization of the relay AA). The de-energization of the relay ZZ is effected with a delay, so that the relay ZZ is not immediately de-energized when the sensor T22 opens subsequent to the passage of the last article 9, but is de-energized only after a short delay which is sufficient to bring the last article 9 from the sensor T22 to the belt 19. Upon de-energization of the relay ZZ, its normally open contact zz1 opens, so that the relay BB too, is de-energized, whereupon its normally open contact bb1 opens and thus interrupts the circuit of the solenoid switch M2, causing the motors M21 and M22 to be de-energized.

The above-described arrangement ensures that the standby machine V3 never starts operation for only a few articles 9, but becomes operational only when at least as many articles will be advanced to it as can be stored on the belts 13 and 14, or 17 and 18. In this manner a frequent energization and de-energization of the standby machine V3 is avoided and thus a normal packing operation is ensured.

Assuming now that the sensor T11 is closed because of a breakdown of the machine V1, then in a manner as described above, the relays A, B, D and Z are energized. Further, by means of the deflecting arm $15_1$ of the aligning apparatus AR1, articles 9 are advanced via the article-withdrawing belt 17 and the buffer belt 18 to the collecting belt 19. The latter occurrence, however, takes place only if the packing machine V2 operates. Should this not be the case and thus the standby machine V3 is already supplied with articles by means of the buffer belt 14 as described above, the articles 9 conveyed by the buffer belt 18 are not transferred to the collecting belt 19, but are directed into the collecting bin 22, because the associated chute portion $25_1$ is in its bypassing position. In such a case the relay D is not energized because the normally closed contact dd2 is already open when the normally open contact b2 closes due to the energization of the relay B. As a result, the normally open contact d3 of the relay D will also not be closed, so that the pivotal chute portion $25_2$ of the already operating buffer belt 14 does not assume its bypassing state, but remains in the conveying position. The two pivotal chute portions $25_1$ and $25_2$ associated with the respective buffer belts 18 and 14 are thus interlocked with one another in such a manner that in each instance only one of them can feed articles to the collecting belt 19.

Should the sensor T31 close because of an excessively large accumulation on the belt 20 in front of the standby machine V3, the solenoid ASM3 of the associated article eliminator $28_3$ is energized, so that the latter temporarily suspends further supply of articles 9 for a short period until the excessive accumulation is reduced.

It is to be understood that a system of the above-outlined kind may have more than two normally operating machines. Each additional normally operating machine has to be provided with an aligning apparatus similar to the apparatus AR1 or AR2, together with a deflector arm $15_1$ or $15_2$ and with belts which correspond to the belts 3, 17 and 18, together with the associated elements.

Although the above-described article-feeding system is particularly adapted for serving packing machines that package longitudinal articles, the machines V1, V2 and V3 can be replaced by other machines, for example, that handle round articles, since the aligning apparatuses are also adapted to separate and space articles of round shape.

The above-described system according to the invention has significant advantages over known systems normally operating with two or more machines. It has limited spatial requirements and can be adapted with ease to the available space since the position of the discharge portions, the turntables 11 and the deflecting arms $15_1$, $15_2$ may be located practically anywhere. The collecting bins 22 and 39 are easily accessible. By virtue of the fact that the standby machine V3 starts its operation only in case of the presence of a significant number of articles, there is ensured a particularly uniform and safe operation of the system.

It will be understood that the above description of the present invention is susceptible to various modifications, changes and adaptations, and the same are intended to be comprehended within the meaning and range of equivalents of the appended claims.

What is claimed is:

1. In a system for feeding spaced, serially arranged articles to a plurality of article processing machines operatively connected to the system and including a plurality of normally, simultaneously operating article processing first machines and a standby article processing second machine for assuming the operation of a non-operating first machine; the improvement comprising (a) a plurality of first article aligning apparatuses, one associated with each said first machine for aligning and serially arranging randomly received articles;

(b) a second article aligning apparatus associated with said second machine for aligning and serially arranging randomly received articles;

(c) a first conveyor means extending from each said article aligning apparatus to the respective first and second machines for supplying serially arranged articles to the respective first and second machines from the article aligning apparatus associated therewith;

(d) an article deflecting means operatively connected with each said first article aligning apparatus; each said article deflecting means having a first position for routing the articles on the associated first article aligning apparatus to the associated first conveyor means and a second position;

(e) a second conveyor means extending from each said first article aligning apparatus to said second article aligning apparatus; in said second position of said article deflecting means the articles on the associated first article aligning apparatus being routed to the associated second conveyor means; said second conveyor means including (1) a collecting conveyor having an inlet and an outlet that extends to said second article aligning apparatus for feeding articles thereto;

(2) a plurality of buffer conveyor means extending from each said first article aligning apparatus to said inlet of said collecting conveyor for feeding articles to said collecting conveyor from that first article aligning apparatus where the associated said article deflecting means is in its second position;

(f) separate drive means connected to each said buffer conveyor means;

(g) energizing means for energizing the respective said drive means when the respective said article deflecting means assumes its said second position; and (h) actuating means for individually moving each article deflecting means into one of said positions.

2. A system as defined in claim 1, wherein each article aligning apparatus comprises a turntable on which articles are deposited at random and a stationary guide rail for aligning the articles in a serial relationship.

3. A system as defined in claim 1, further comprising a separate sensor arranged to each said buffer conveyor means in the vicinity of said inlet of said collecting conveyor for responding to the articles moving past on the respective buffer conveyor means; a control circuit connected to said sensors, said drive means and said actuating means; said control circuit including first control means for de-energizing the respective said drive means upon movement of the associated article deflecting means from said second position into said first position provided the respective sensor has not yet responded to articles advanced on the associated said buffer conveyor means; said control circuit further including second control means for de-energizing the respective said drive means upon movement of the associated article deflecting means from said second position into said first position provided all articles on the associated said buffer conveyor means have moved past the sensor.

4. A system as defined in claim 1, further comprising (i) a plurality of sensors, one associated with the first conveyor means of each said first machine for responding to an article accumulation beyond a predetermined extent on the respective first conveyor means in front of the respective said first machine; and (j) a control circuit connected to said sensors and said actuating means; said control circuit including control means for setting the respective said article deflecting means from its said first position into its said second position when the associated sensor responds.

5. A system as defined in claim 4, wherein said first conveyor means associated with said first machines include an article eliminating means having an inoperative state in which it is without effect on the articles advanced on the respective first conveyor means and an operative state in which it detours the articles for preventing them from being advanced to the respective said first machine; said control circuit being operatively connected to said article eliminating means and further including additional control means for setting the respective article eliminating means into its said operative state when the associated sensor responds.

6. A system as defined in claim 5, wherein said first conveyor means associated with said second machine includes an additional article eliminating means having an inoperartive state in which it is without effect on the articles advanced on the first conveyor means associated with said second machine and an operative state in which it detours the articles for preventing them from being advanced to said second machine; further comprising an additional sensor arranged at the first conveying means associated with said second machine for responding to an article accumulation beyond a predetermined extent on the first conveyor means associated with said second machine; and a control means connected to said additional sensor and to said additional article eliminating means for setting said additional article eliminating means into its operative state when said additional sensor responds.

7. A system as defined in claim 5, wherein each said article eliminating means includes two longitudinally aligned first and second continuous conveyor belts each trained about respective first and second belt-deflecting rollers; means for changing the distance between the first and second deflecting rollers that support adjoining ends of the respective first and second conveyor belts; in said inoperative state said adjoining ends being sufficiently close to one another for effecting transfer of articles from one of said conveyor belts to the other and in said operative state said adjoining ends being sufficiently separated for defining a gap through which fall all the articles advanced on one of said conveyor belts towards the other.

8. A system as defined in claim 1 the improvement further comprising article separators arranged at an outlet of each buffer conveyor means and having a first position for routing the articles from the respective buffer conveyor means onto said collecting conveyor and a second position for routing the articles from the respective buffer conveyor means away from said collecting conveyor.

9. A system as defined in claim 8, wherein said buffer conveyor means include a first and a second buffer conveyor belt associated with different first machines and extending parallel to one another to the respective said article separator and wherein said first and second buffer conveyor belts are of unlike lengths.

10. A system as defined in claim 9, wherein the shorter buffer conveyor belt is wider than the longer buffer conveyor belt.

11. A system as defined in claim 8, further comprising a control circuit interconnecting said article separators with one another; said control circuit including control means for allowing at any time only a sole one of said article separators to assume its said first position.

12. A system as defined in claim 8, wherein each said article separator includes a chute.

13. In a system for feeding spaced, serially arranged articles to a plurality of article processing machines operatively connected to the system and including a plurality of normally, simultaneously operating article processing first machines and a standby article processing second machine for assuming the operation of a non-operating first machine; the improvement comprising (a) a plurality of first article aligning apparatuses, one associated with each said first machine;

(b) a second article aligning apparatus associated with said second machine;

(c) a first conveyor means extending from each said article aligning apparatus to the respective first and second machines for supplying serially arranged articles to the respective first and second machines from the article aligning apparatus associated therewith;

(d) an article deflecting means operatively connected with each said first article aligning apparatus; each said article deflecting means having a first position for routing the articles on the associated first article aligning apparatus to the associated first conveyor means and a second position;

(e) a second conveyor means extending from each said first article aligning apparatus to said second article aligning apparatus; in said second position of said article deflecting means the articles on the associated first article aligning apparatus being routed to the associated second conveyor means; said second conveyor means including (1) a collecting conveyor having an inlet and an outlet that extends to said second article aligning apparatus for feeding articles thereto;

(2) a plurality of buffer conveyor means extending from each said first article aligning apparatus to said inlet of said collecting conveyor for feeding articles to said collecting conveyor from that first article aligning apparatus were the associated said article deflecting means is in its said second position; said buffer conveyor means include a first and a second buffer conveyor belt associated with different first machines and extending parallel to one another to the respective said article separator; said first and second buffer conveyor belts being of unlike lengths; the shorter buffer conveyor belt being wider than the longer buffer conveyor belt;

(f) article separators arranged at an outlet of each buffer conveyor means and having a first position for routing the articles from the respective buffer conveyor means onto said collecting conveyor and a second position for routing the articles from the respective buffer conveyor means away from said collecting conveyor; and (g) actuating means for individually moving each article deflecting means into one of its said positions.

14. In a system for feeding spaced, serially arranged articles to a plurality of article processing machines operatively connected to the system and including a plurality of normally, simultaneously operating article processing first machines and a standby article processing second machine for assuming the operation of a non-operating first machine; the improvement comprising (a) a plurality of first article aligning apparatuses, one associated with each said first machine;

(b) a second article aligning apparatus associated with said second machine;

(c) a first conveyor means extending from each said article aligning apparatus to the respective first and second machines for supplying serially arranged articles to the respective first and second machines from the article aligning apparatus associated therewith;

(d) an article deflecting means operatively connected with each said first article aligning apparatus; each said article deflecting means having a first position for routing the articles on the associated first article aligning apparatus to the associated first conveyor means and a second position;

(e) a second conveyor means extending from each said first article aligning apparatus to said second article aligning apparatus; in said second position of said article deflecting means the articles on the associated first article aligning apparatus being routed to the associated second conveyor means; said second conveyor means including (1) a collecting conveyor having an inlet and an outlet that extends to said second article aligning apparatus for feeding articles thereto;

(2) a plurality of buffer conveyor means extending from each said first article aligning apparatus to said inlet of said collecting conveyor for feeding articles to said collecting conveyor from that first article aligning apparatus where the associated said article deflecting means is in its said second position;

(f) separate drive means connected to each said buffer conveyor means;

(g) energizing means for energizing the respective said drive means when the respective said article deflecting means assumes its said second position;

(h) actuating means for individually moving each article deflecting means into one of said positions;

(i) a separate sensor arranged at each said buffer conveyor means in the vicinity of said inlet of said collecting conveyor for responding to the articles moving past on the respective buffer conveyor means; and (j) a control circuit connected to said sensors, said drive means and said actuating means; said control circuit including (1) first control means for de-energizing the respective said drive means upon movement of the associated article deflecting means from said second position into said first position provided the respective sensor has not yet responded to articles advanced on the associated said buffer conveyor means;

(2) second control means for de-energizing the respective said drive means upon movement of the associated article deflecting means from said second position into said first position provided all articles on the associated said buffer conveyor means have moved past the sensor.

* * * * *